US006483257B1

(12) United States Patent
Henderson et al.

(10) Patent No.: US 6,483,257 B1
(45) Date of Patent: Nov. 19, 2002

(54) IGNITOR PULSE VARIABLE REDUCTION METHOD AND APPARATUS

(75) Inventors: Larry R. Henderson, deceased, late of Zirconia, NC (US), by Doris A Henderson, legal representative; Byron R. Collins, Tuxedo, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/580,387

(22) Filed: May 26, 2000

(51) Int. Cl.[7] ..... H05B 37/02
(52) U.S. Cl. ..... 315/291; 315/209 R; 315/289
(58) Field of Search ..... 315/289, 290, 315/291, 209 CD, 219, 244, 276, DIG. 5, 307, 225

(56) References Cited

U.S. PATENT DOCUMENTS

| | | | | | |
|---|---|---|---|---|---|
| 4,695,771 | A | * | 9/1987 | Hallay | 315/244 |
| 5,801,494 | A | * | 9/1998 | Herres et al. | 315/289 |
| 5,892,332 | A | * | 4/1999 | Drews et al. | 315/289 |
| 5,945,784 | A | * | 8/1999 | Mattas | 315/289 |
| 6,078,143 | A | * | 6/2000 | Nerone | 315/224 |
| 6,127,787 | A | * | 10/2000 | Strong, III et al. | 315/289 |
| 6,323,603 | B1 | * | 11/2001 | Persson | 315/209 R |

OTHER PUBLICATIONS

B.R. Collins and R.E. Wenner, "Starting pulse tester for high pressure sodium systems", *Journal of IES*, Jul. 1976, pp. 195–200.

Cohen, et al., "The application of Penning mixture starting gases to high–pressure sodium lamps", *Lighting Design and Application*, Sep. 1975, pp. 12–17.

Cohen, et al., "Heat Starting a High–Pressure Sodium Lamp", *Journal of IES*, Jul. 1974, pp. 330–335.

* cited by examiner

*Primary Examiner*—Don Wong
*Assistant Examiner*—Wilson Lee
(74) *Attorney, Agent, or Firm*—Fay, Sharpe, Fagan, Minnich & McKee, LLP

(57) ABSTRACT

In a lighting system 10, a voltage pulse clamping device 12 is connected across a ballast coil 20. The clamping device 12 regulates the ignitor output voltage pulse applied to high intensity discharge lamps during startup. The ignitor pulse is developed by an ignitor pulse circuit connected to the lamp 14. The voltage clamping device 12 ensures that the ignitor output voltage does not exceed the maximum voltage rating of the lamp 14 being used, regardless of component tolerances or variations in the power supply 24 line voltage. Lamp 14 performance can be increased by the application of the appropriate voltage pulse to the lamp 14, thereby avoiding degradation of the lamp ballast due to excessively high ignitor pulses.

18 Claims, 7 Drawing Sheets

IGNITOR PULSE VARIABLE REDUCTION METHOD AND APPARATUS

BACKGROUND OF THE INVENTION

1. Field of the Invention

The present invention relates to the control of high intensity discharge lamps, and particularly to the ignitor pulse starting circuit, required for the initial start up and operation of high intensity discharge (HID) lighting systems.

2. Discussion of the Art

Conventionally, several steps are involved in the start up and sustained operation of an HID lamp. A first step is inherent to lamp design and involves the reduction of arc tube internal gas pressure with respect to atmosphere. A second step, includes the application of a preselected voltage to a set of electrodes to initiate and sustain an arc discharge in the constituent gas of an HID arc tube. A third step, involves using an appropriate gas mixture, which is typically a combination of at least two gases, one of which makes up only about 1% of the total volume and is called the minor constituent. The minor constituent aids in the arc discharge and subsequent thermionic emission of the primary gas mixture, called the major constituent. In the process of operating an HID lamp, commonly, an ignitor circuit is used to generate high voltage pulses to ionize the gases and initiate the arc discharge. As an alternative, a starter electrode may be used to apply either a heating effect, or a high voltage, which aids in the generation of the arc discharge during start up. It is to be noted that a starter electrode is not commonly used with ignitors.

A problem encountered with the use of ignitor circuits, is an inherent wide variation of ignitor pulse heights. The variation exists due to differing component tolerances. Another obstacle is a lack of interchangeability between ballast types. There will, for example, be different inductive and capacitive loading of the ignitor pulse by ballasts from different manufacturers, as well as different pulse specifications and different ballast designs.

BRIEF SUMMARY OF THE INVENTION

An ignitor pulse variable reduction method and apparatus, of the present invention overcomes the limitations of the prior art starting mechanisms by providing a universal ignitor for the different types of lamps and allows interchangeability of lamps, ignitors and ballasts between different lighting systems and manufacturers. While it is possible to match some components of a system to obtain better operational performance, the drawbacks include tighter manufacturing tolerances across all of these various components, and the associated increase in manufacturing costs.

The ignitor pulse variable reduction invention substantially reduces the requirement for tighter component tolerances by adding a voltage pulse clamping device which will ensure that the ignitor output voltage does not exceed the maximum lamp voltage rating, regardless of component tolerances or variations in supply line voltage. If the population of ignitor voltages is then set higher than the clamping voltage, all of the ignitors would then have approximately the same voltage level, due to the clamping device. The population of ignitor voltage levels, therefore, becomes a function of tolerance variations within the population of the clamping devices.

DETAILED DESCRIPTION OF THE INVENTION

As is well known in the art, starting techniques for an HID lamp relies on electrical circuit properties which generate a preselected high voltage pulse of a specified width, or time duration measured in microseconds. This high voltage pulse, or ignitor pulse, generates free electrons from the electrode metal and initiates the arc discharge by having these free electrons collide with, and impart energy to, the gas atoms in the lamp. The actual voltage pulse imparted to the lamp, can vary, with the amount of variability being dependent on the variabilility of component tolerances. A problem associated with this variability is that some circuits can impart an ignitor pulse level which is too high, and is therefore detrimental to lamp operation and longevity, causing degradation of system components, such as ballast insulation deterioration.

Solving the problem of variability through the use of tighter tolerance on the components is one obvious solution, but there are manufacturing and economic problems with this. The present invention substantially reduces the requirement for tighter tolerances on these components by the addition of a voltage pulse clamping device which ensures that the ignitor output voltage pulse does not exceed the specified starting voltage for a particular HID lamp system. By setting the ignitor output voltage pulse higher than the recommended lamp starting voltage, then adding a voltage pulse clamping device to the circuit, the pulse can be clamped, or limited to a preselected voltage level. The variability of component tolerances will no longer be a major factor and the population of ignitor voltage pulses will be dependent on the clamping device tolerances. Clamping devices which can be used include, but are not limited to, Transorbs, zener diodes, and metal oxide varistors (MOVs).

Figure 1:
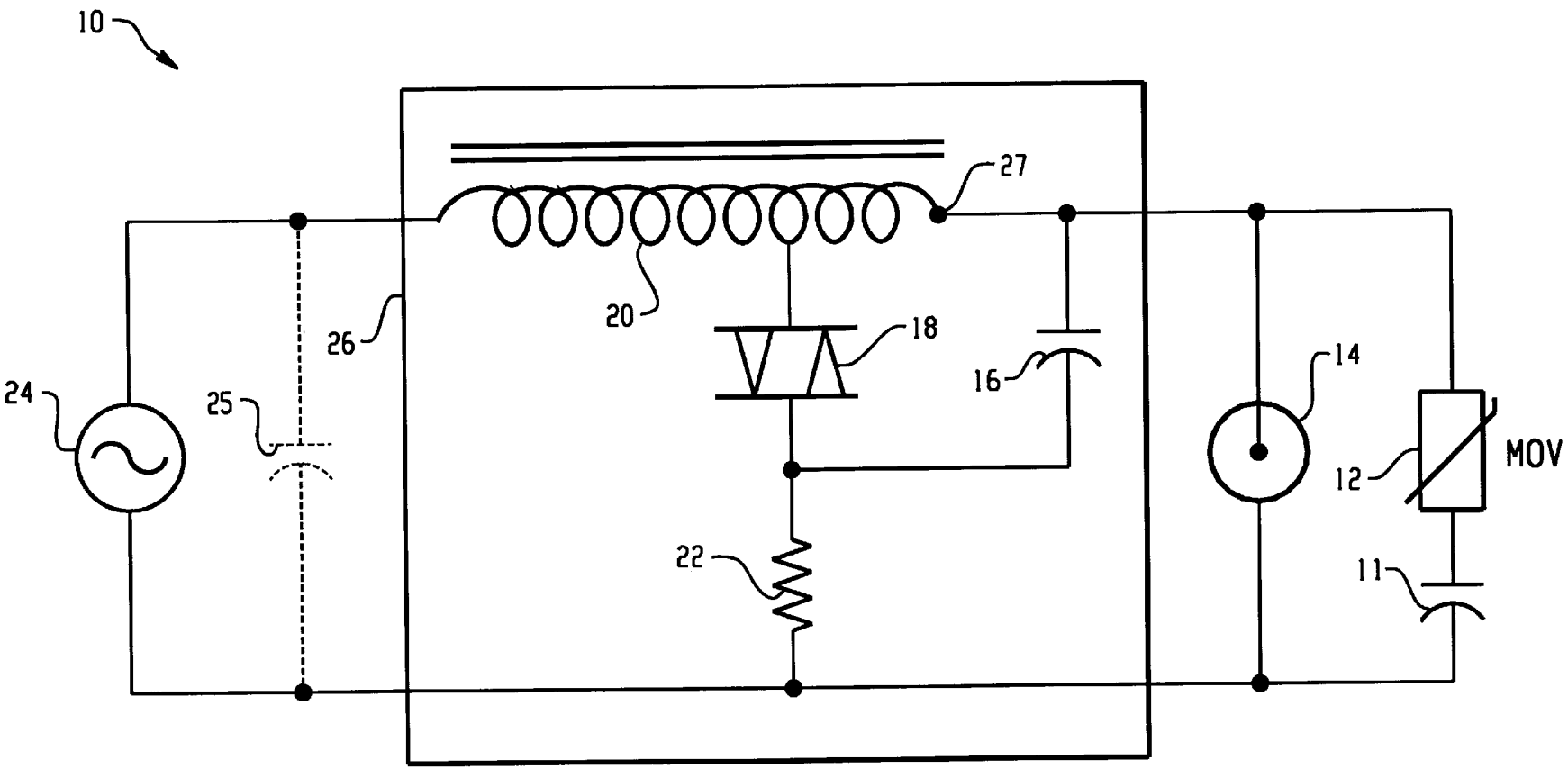
FIG. 1 is a circuit schematic of an HID lighting system circuit and shows the original embodiment of the ignitor pulse variable reduction clamping device.

With reference to FIG. 1 of the drawings, an HID lighting system 10, according to the present invention is depicted. The system 10 may also include a fail safe capacitor 11, a clamping device 12, a lamp 14, a firing capacitor 16, a break-over device 18, such as, but not limited to a SIDAC, a coil 20, a resistor 22, and an alternating current (A/C) power source 24, which may be a 60 Hz power supply. The firing capacitor 16, break-over device 18, coil 20, and resistor 22, are components of an ignitor pulse circuit (16, 18, 20, and 22,) which is used as part of ballast 26 to control power supplied to lamp 14 from power supply 24. The fail safe capacitor 11, limits the current flow through the clamping device 12, in the event that the clamping device fails to a shorted condition, and can reduce the probability of clamping device 12 failure in the first place. It is to be understood that the ignitor circuit, while shown as part of the ballast, may also be separate from the ballast. The fail safe capacitor may be a 0.1 Mfd value, or a lesser rated value capacitor.

In a configuration (not shown) in which the clamping device 12 is not used in the circuit, the power source 24 charges the firing capacitor 16 through the coil 20 and the resistor 22. As is well known to those skilled in the art, the power source 24 of the circuit causes the firing capacitor 16 to charge until the rated break over voltage of the break-over device 18 is exceeded, whereupon the break-over device SIDAC 18 changes rapidly from a non-conducting state, to a conducting state, and imparts an ignition pulse on lamp 14. By this operation, the ignitor pulse circuit (16, 18, 20, 22) performs the start up of an HID lighting system. Without the clamping device 12 in the circuit, the actual voltage pulse delivered to the lamp 14 can vary from a desired or preselected value. The amount of variation being dependent on the various component tolerances of the firing capacitor 16, the SIDAC 18, the coil 20, the resistor 22, and any fluctuations of the power source 24.

With continuing reference to FIG. 1, in one embodiment of the present invention, the fail safe capacitor 11, and the clamping device 12, are placed in serial connection in the lighting system 10, as shown, and are in electrical connection across the entire coil 20. The power source 24 charges the firing capacitor 16 through the coil 20 and the resistor 22. In this embodiment the firing capacitor 16, charges until the rated break over voltage of the clamping device 12 is exceeded, whereby it changes to a conducting state, and imparts an ignition pulse to the lamp. The clamping device 12, along with the transformer action of coil 20, substantially determines the operating characteristics of the ignition pulse. For example, when the clamping device 12 used is a 1000 VAC rated MOV, it can clamp at approximately 2000 volts peak (Vp). Moreover, two of these clamping devices connected in series can be used to clamp at approximately 4000 Vp. However, it is to be appreciated that the entire pulse path will also include system capacitance 25, such as parasitic capacitance of line input, power factor corrections, and/or transformer capacitance.

The clamping effect on the ignitor pulse ensures that the ignition pulse imparted to the lamp 14 does not exceed a preselected ignition pulse level and will be of a nearly equal value across a population of clamping devices. Any variation in the ignitor pulse, therefore, becomes a function of component tolerance of the clamping device 12. It is noted in FIG. 1, clamping device 12 is not depicted as part of ballast 26. However, FIG. 1 is drawn in this manner for convenience, and clamping device 12 may be considered a separate element as shown in FIG. 1 or alternatively, part of ballast 26 as is depicted in FIG. 2.

Figure 2:
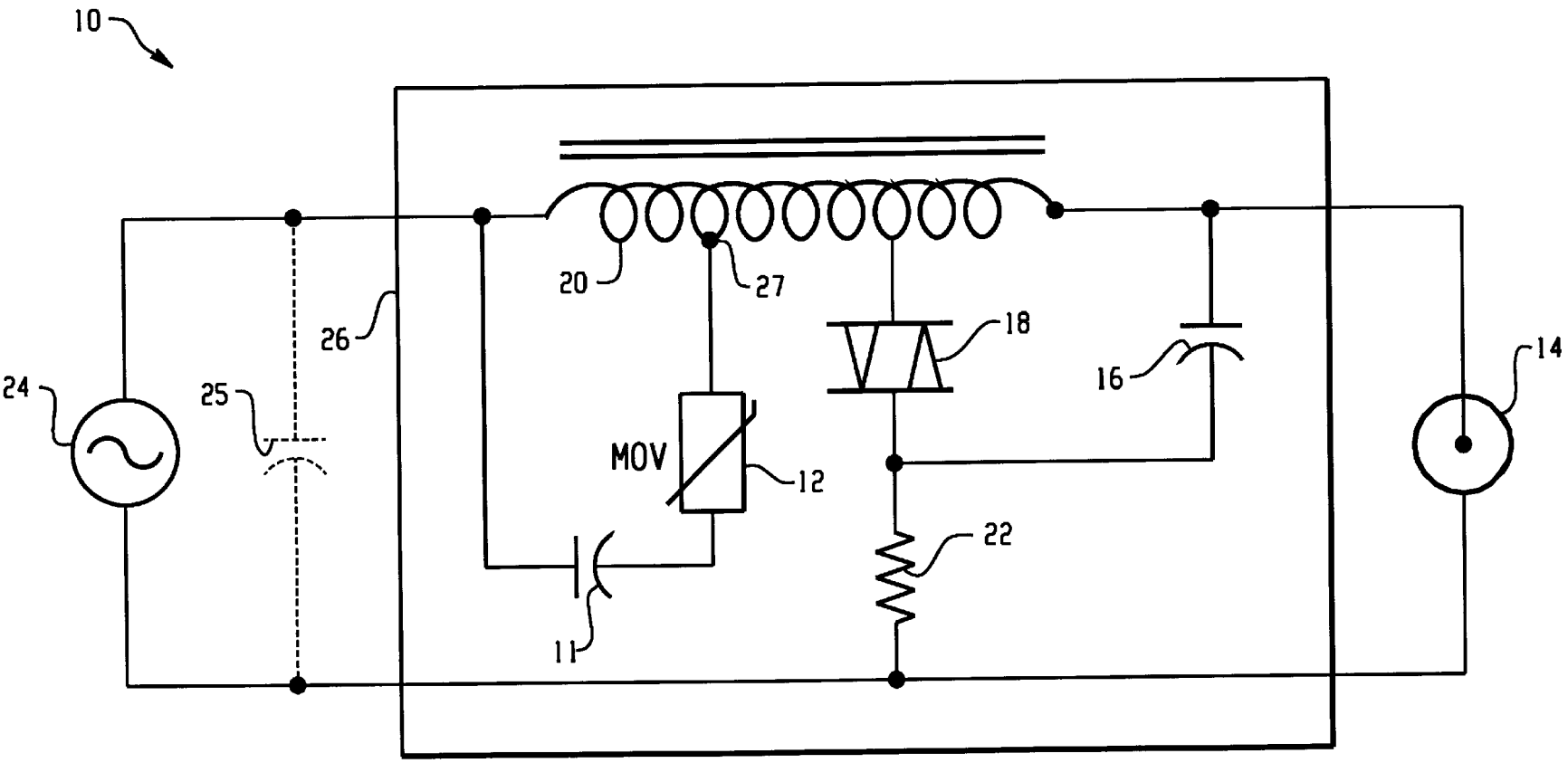
FIG. 2 is a circuit schematic of an HID lighting system and shows an improvement on the original embodiment of the ignitor pulse variable reduction clamping device.

With reference to FIG. 2 of the drawings, a preferred embodiment of the invention is implemented with a clamping device 12, and a fail safe capacitor 11, inserted into the circuit in a manner which preselects the number of coil 20 windings or turns used, and through transformer action affects the clamping operation. The connection of the clamping device 12, along with the transformer action of coil 20, substantially determines the clamping device 12 operating parameters, although system variables, including system capacitance 25 will also be part of the current pulse path. In the preferred embodiment of FIG. 2, a power source 24 supplies energy to the circuit and charges the firing capacitor 16 through the coil 20 and the resistor 22. The firing capacitor 16 charges until the rated break over voltage of the clamping device 12 is exceeded through transformer action, whereupon the clamping device 12 changes rapidly from a non-conducting, to a conducting state, and imparts an ignition pulse on lamp 14. Furthermore, in this preferred embodiment, the clamping device 12, can be of a much lower voltage rating, such as a 120 VAC rated MOV for example. The selection on the number of windings of coil 20 used, along with the action of the clamping device 12, yields a reduction in the variation of the ignitor pulse voltage levels across a population of HID lighting systems.

It is also to be noted that clamping device 12 may be a device with variable or adjustable clamping values. Use of such a device allows a user to adjust the clamping action. In yet another embodiment, tap 27, may be configured as an adjustable tap whereby the number of turns used, and which determines the clamping device 12 connection, may be adjustable within a single system. These foregoing embodiments increase the operating range, and usefulness of the clamping circuit. In laboratory testing, the bobbin flange from an output coil of various ballasts was removed and insulation removed by scrapping it off of the wire windings to create an electrical connection point or tap 27, at the end layers of the coil 20 windings. For testing purposes the tap 27 was positioned at 60, 120, 180, 240, 300, and 347 turns of the coil 20 windings. Tests were then performed with three separate MOVs, rated at 150 VAC, 250 VAC, and 300 VAC respectively.

Figure 3:
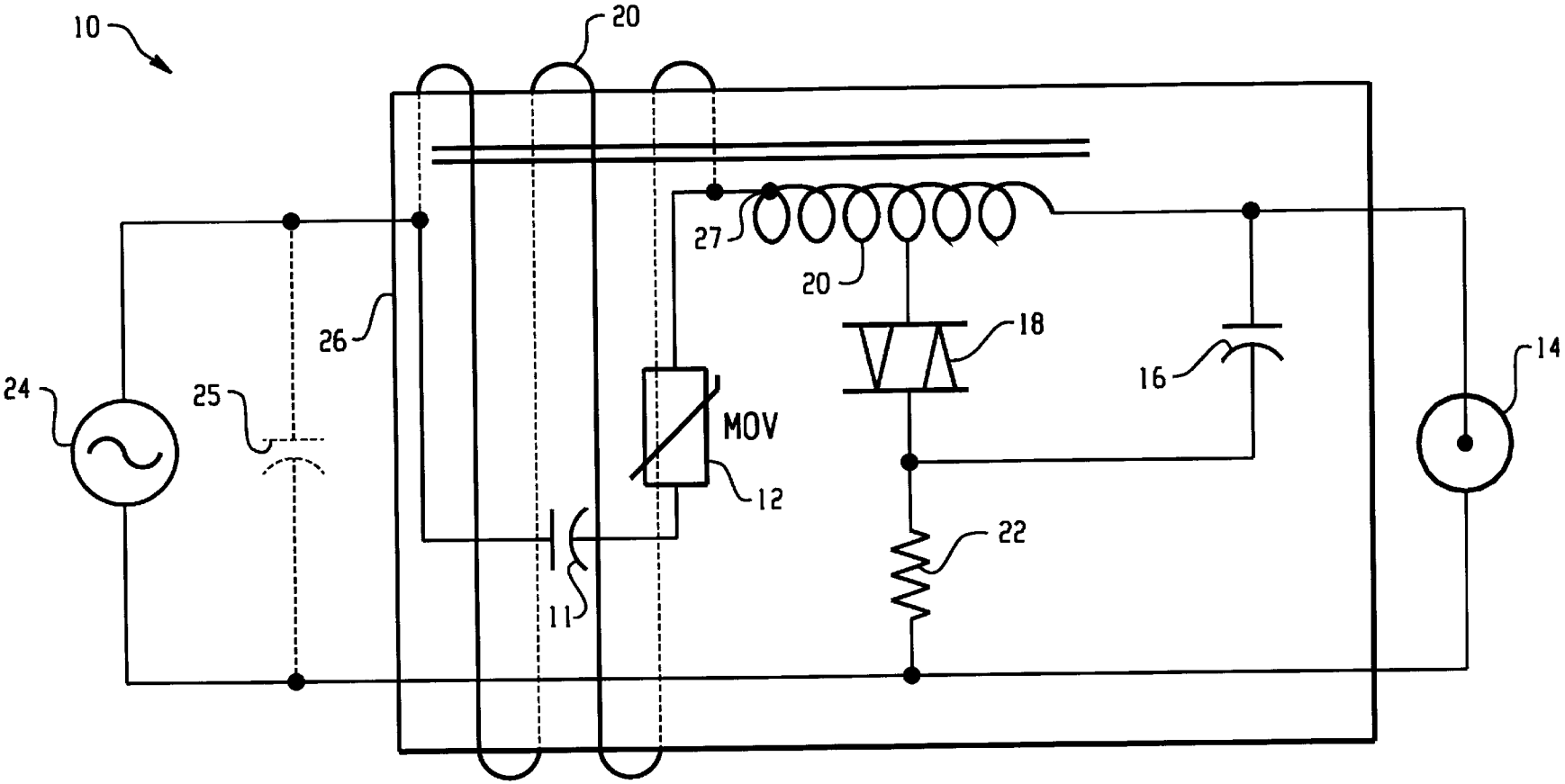
FIG. 3 is a further embodiment according to the present invention.

Turning to FIG. 3, a further embodiment according to the present embodiment is illustrated. In this embodiment, at least some turns of coil 20 are placed around the outside of ballast 26, and clamping device 12 is connected to these turns. In this embodiment, the core of the ballast 26 is metal (e.g. steel), and does not respond to the high frequency pulse. By the design, a true transformer is configured, as opposed to an autotransformer. It is to be understood that all of the coil may be placed outside of ballast 26, and the clamping device 12 may be internal (with external connections), or may be external to the ballast 26.

Figure 4:
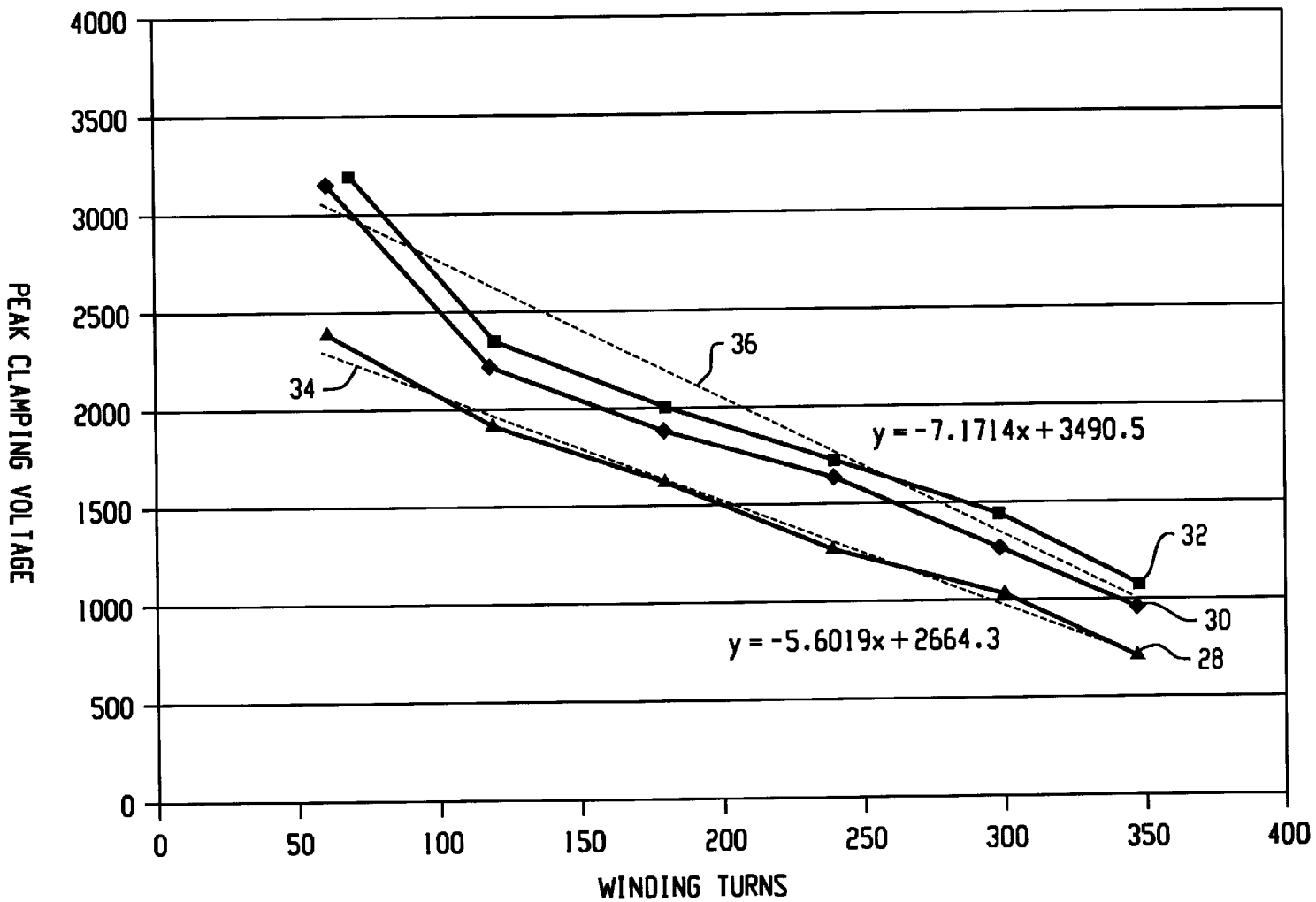
FIG. 4 is a graph of test data and illustrates the effects of the clamping device on ignitor peak voltage levels as a function of the number of turns on the winding of the coil.

With reference to FIG. 4, the test data yielded three curves, solid lines (28, 30, 32), for the three different rated MOV clamping devices. The test data corresponds to the peak clamping voltage graphed as a function of the number of turns on the coil 20 windings, where tap 27 is positioned on the windings. Curve 28 is representative of the data for the 150 VAC rated MOV. Curve 30 is representative of the data for the 250 VAC rated MOV. Curve 32 is representative of the data for the 300 VAC rated MOV. Analysis of the graphed test data reveals that as the number of turns on tap 27, of coil 20 decreases, the peak clamping voltage increases in an approximately linear fashion. Using linear regression statistical analysis yields a set of curves, dashed lines (34–36), and a corresponding linear equation which is used to calculate the number of turns on the coil 20 windings which yields a desired peak clamping voltage for a particular type of an HID lamp.

The test data for the 150 VAC rated MOV clamping device, and a particular ballast, yields curve 34, dashed line in FIG. 4, of which the corresponding linear equation, of the form y=mx+b, is given by:

$$y=-5.6019x+2664.4 \qquad \text{EQ. 1}$$

The test data for the 250 VAC rated MOV, and the 300 VAC rated MOV, for a particular ballast, were combined to yield curve 36, dashed line in FIG. 3, of which the corresponding linear equation is given by:

$$y=-7.171x+3490.5 \quad \text{EQ. 2}$$

These equations correspond to the ignitor output voltage pulse y as a function of the number of windings x to which the clamping device 12 is connected via tap 27. These same equations are then useful for calculating the number of turns on the winding x of coil 20 which yield a preselected ignitor output voltage pulse y. The electrical operation of the clamping device 12 and the transformer action of coil 20 determine the waveform of the ignitor output voltage pulse. It is therefore possible to regulate the ignitor pulse voltage level applied to an HID lamp by properly selecting a clamping device 12 and calculating the number of turns required to obtain the desired ignitor output voltage pulse for a specific type of HID lamp and ballast system. This allows for optimization of the pulse peak and width for a particular lamp and ballast combination. Similarly, test data for other types of lamps and ballasts will yield a linear equation of the form y=mx+b, which is then used to calculate tap 27 placement of the clamping device. The linear equation is derived by application of statistical analysis, linear regression to the test data.

Figure 5:
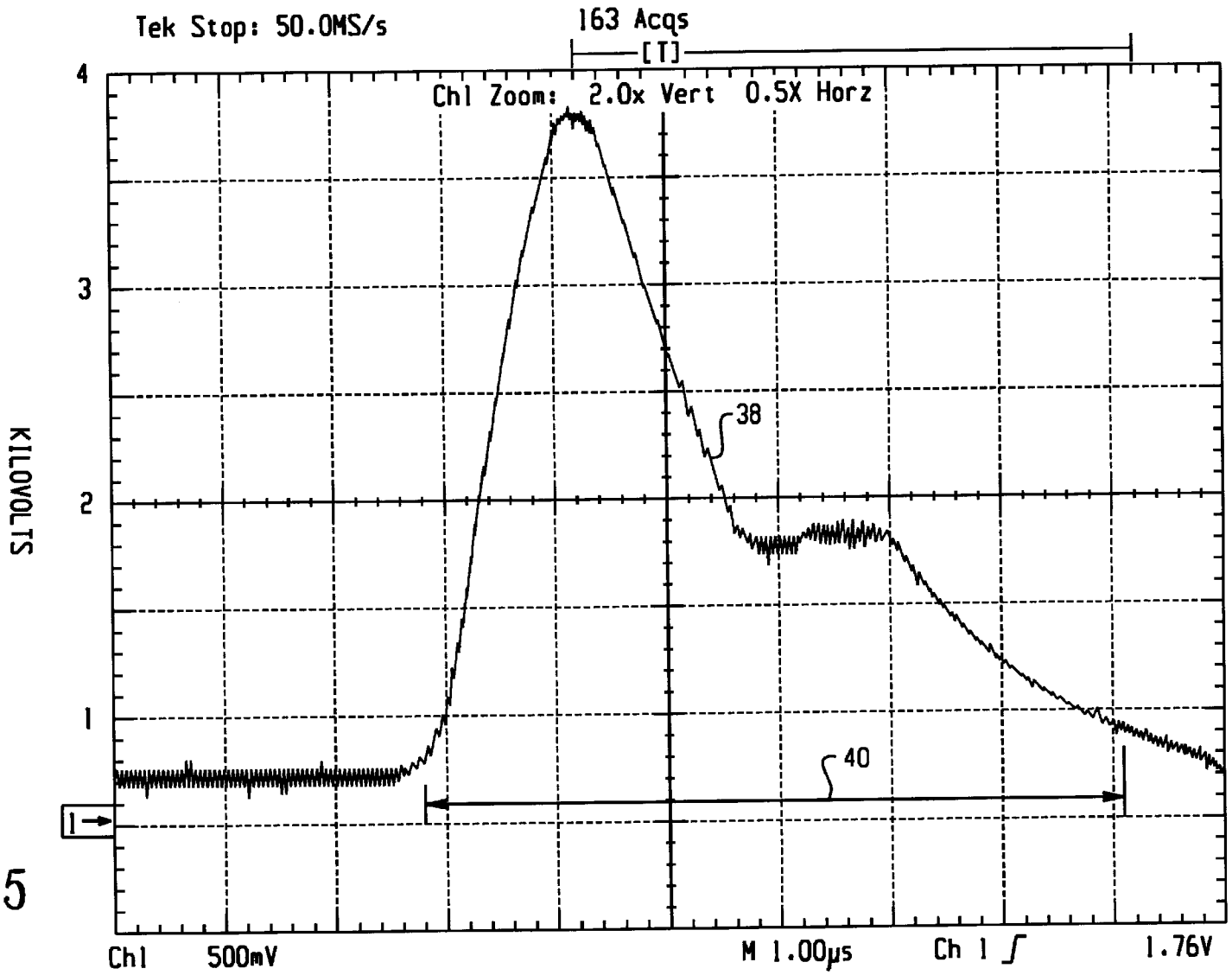
FIG. 5 is a graph of test data and illustrates the effects on the HID lighting system without the clamping device.

Additional testing to determine the feasibility of the concept was performed, and circuit voltage waveform data on lamp 14 was obtained using an oscilloscope. With reference to FIG. 5, a voltage waveform 38 was generated by the ignitor circuit without the clamping device 12 in the lighting system circuit. The vertical axis of the graph is in increments of 500 volts (0.5 kilovolts), the peak of the voltage waveform has a maximum of approximately 3600 Vp, without the clamping device 12 in the circuit. The horizontal axis is in 1 microsecond increments, and a major portion of the ignitor pulse energy is imparted to lamp 14 in approximately 5 microseconds, during an ignitor pulse duration 40.

Figure 6:
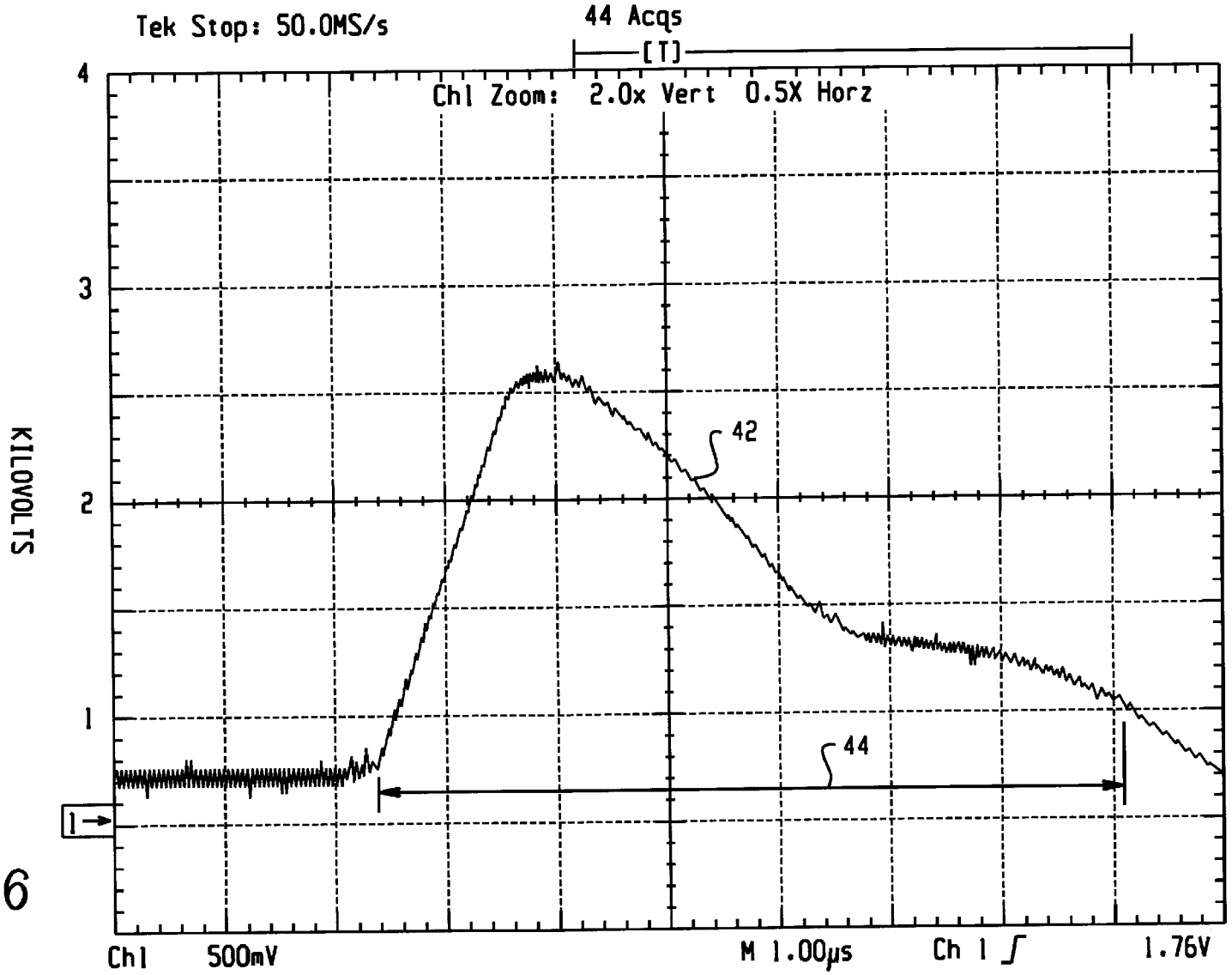
FIG. 6 is a graph of test data and illustrates the effects of a 1000 VAC rated, metal oxide varistor, clamping device.

With reference to FIG. 6, depicted is a voltage waveform 42 generated by a 1000 VAC rated clamping device across the entire coil 20 of the lighting system circuit. The vertical axis of the graph is in increments of 500 volts, the peak of the voltage waveform has a maximum of approximately 2600 Vp, with the clamping device 12 in the circuit. The horizontal axis is in 1 microsecond increments, and a major portion of the ignitor pulse energy is imparted to lamp 14 in approximately 6 microseconds, during an ignitor pulse duration 44.

Figure 7:
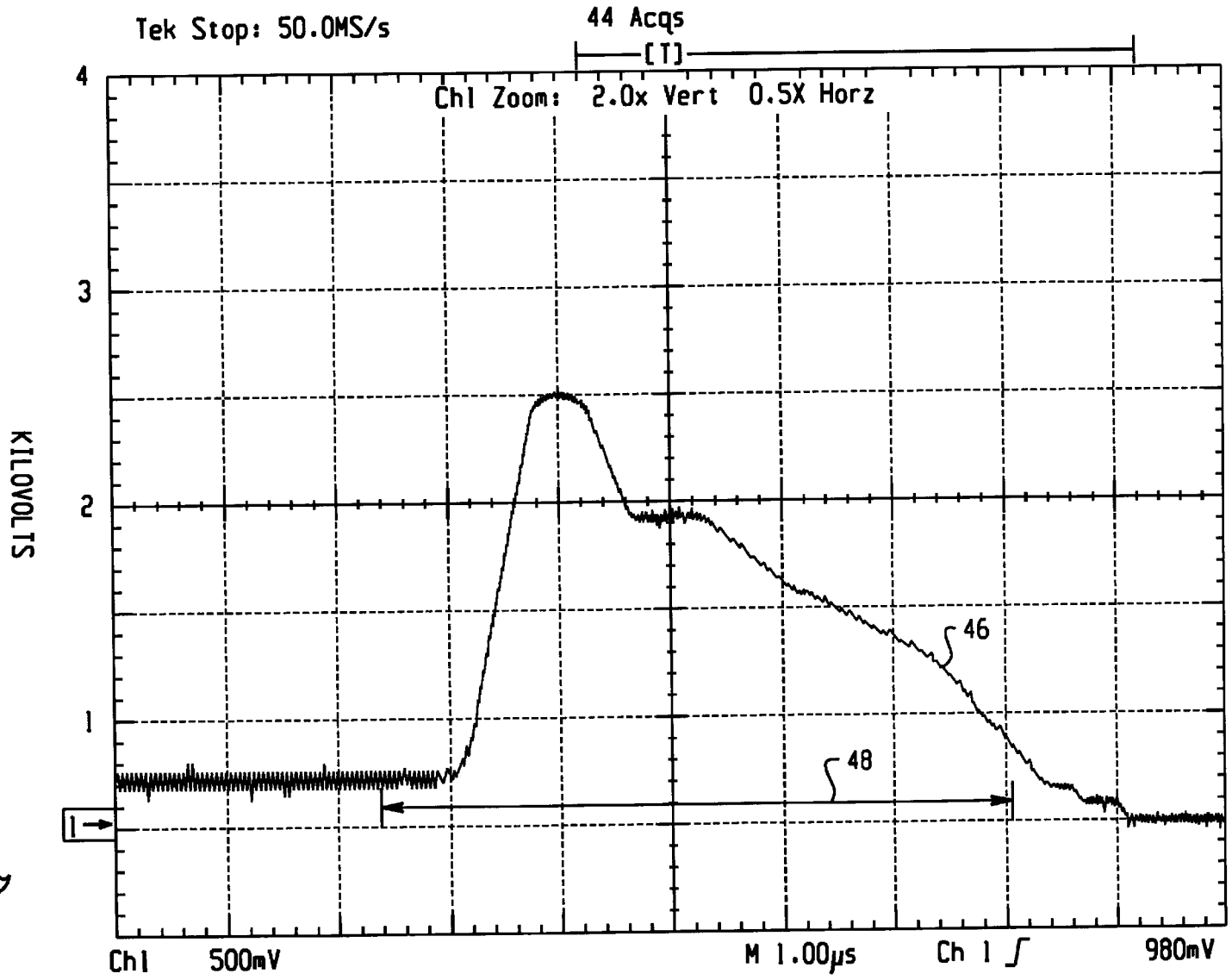
FIG. 7 is a graph of test data and illustrates the effects of a 150 VAC rated, metal oxide varistor, clamping device applied across a tapped portion of the reactor.

With reference to FIG. 7, a voltage waveform 46 was generated with a 150 VAC rated clamping device across a predetermined number of windings of coil 20, in the lighting system circuit. The vertical axis of the graph is in increments of 500 volts, the peak of the voltage waveform has a maximum of approximately 2500 Vp, with the clamping device 12 in the circuit. The horizontal axis is in 1 microsecond increments, and a major portion of the ignitor pulse energy is imparted to lamp 14 in approximately 5 microseconds, during an ignitor pulse duration 48.

Thus, the present invention uses fail safe capacitor 11, and a single, small, and inexpensive clamping device 12, which controls ignition pulse levels within a much narrower tolerance band than would otherwise be possible using several components. This allows for lower manufacturing costs and a less bulky solution for the mechanisms required to control the ignition pulse for start up of an HID lighting system.

Inasmuch as the present invention is subject to variation, modifications and changes in detail, it is intended that all matter described throughout this specification and shown in the accompanying drawing be interpreted as illustrative only and not in a limiting sense. Accordingly, it is intended that the invention be limited only by spirit and scope of the hereto attached claims.

What is claimed is:

1. A lighting system including a lamp powered by a power source, the lighting system comprising:

an ignitor circuit in electrical connection with the lamp, wherein the ignitor circuit generates and supplies a starting voltage pulse to the lamp;

a voltage pulse clamping device connected across at least a section of the ignitor circuit, wherein the voltage pulse clamping device limits the upper value of the starting voltage pulse to a preselected level; and a fail safe device in electrical connection with said clamping device in an event the voltage pulse clamping device fails to a conducting state.

2. The lighting system according to claim 1, wherein the lighting system is an HID lighting system, with the ignitor circuit including a system coil having a plurality of windings, and the voltage pulse clamping device is connected across a predetermined number of windings of the system coil.

3. The lighting system according to claim 2, further including an HID lighting system ballast having a plurality of windings, wherein the voltage pulse clamping device is connected across a preselected number of windings of the HID lighting system ballast.

4. The lighting system according to claim 3, wherein the preselected number of windings is calculated by a linear equation.

5. The lighting system according to claim 3, wherein said calculated number of windings is used for selection of at least one of the resistance of said voltage pulse clamping device or the number of windings the voltage pulse clamping device is connected across.

6. The lighting system according to claim 4, wherein a constant x denotes the preselected number of windings and a constant y denotes the preselected starting voltage pulse level and the linear equation is of the form:

$$y=-5.6019x+2664.4,$$

for a 150 VAC rated MOV.

7. The lighting system according to claim 4, wherein a constant x denotes the preselected number of windings and a constant y denotes the preselected starting voltage pulse level and the linear equation is of the form:

$$y=-7.171x+3490.5,$$

for a 250 VAC rated MOV and a 300 VAC rated MOV.

8. The lighting system according to claim 1, wherein clamping action of the voltage pulse clamping device is variable, allowing the output value of the starting voltage pulse received by the lamp to be varied.

9. The lighting system according to claim 1, wherein the voltage pulse clamping device is connected to the ignitor circuit across at least a section of a coil of the ignitor circuit, by a tap.

10. The lighting system according to claim 9, wherein the tap is a variable tap connection.

11. A lighting system, powered by a power source, for reducing variations in a starting voltage pulse delivered to a lamp, the lighting system comprised of:

an ignitor circuit having a system coil, the ignitor circuit in electrical communication with the lamp, wherein the ignitor circuit generates and supplies a starting voltage pulse to the lamp;

a voltage pulse clamping device connected across at least a section of the coil of the ignitor circuit; and a fail safe component in electrical communication with the voltage pulse clamping device, wherein variations of the starting voltage pulse are reduced to tolerance variations of voltage pulse clamping device.

12. The system according to claim 11, wherein devices of the lighting system have wider operational tolerances than a lighting system without the voltage pulse clamping device.

13. The system according to claim 11, wherein said voltage pulse clamping device is connected across a preselected number of output windings of the ignitor coil.

14. A method for reducing variations in an ignition voltage pulse of a lighting system, said method comprising:

connecting a voltage pulse clamping device across at least a section of an ignitor coil of said ignitor circuit;

placing a fail-safe component in electrical connection with said voltage pulse clamping device;

generating the ignition voltage pulse via an ignitor circuit;

clamping the ignition voltage value pulse to a predetermined voltage pulse via connection of the voltage pulse clamping device to at least a section of the ignitor coil; and supplying a clamped voltage pulse, having the predetermined voltage pulse value, to a lamp.

15. The method according to claim 14, wherein the method includes connecting the voltage pulse clamping device across all windings of the ignitor coil.

16. The method according to claim 14, wherein the method includes connecting the voltage pulse clamping device across a predetermined number of windings of the ignitor coil by a tap.

17. The method according to claim 16, wherein the tap is a variable tap connection which allows varying the ignition voltage pulse delivered to the lamp.

18. The method according to claim 14, wherein the predetermined voltage pulse is designed not to exceed the lamp specified ignition voltage pulse rating for a particular lamp system to which the voltage pulse is supplied.

* * * * *